United States Patent [19]

Imazu et al.

[11] 4,454,960

[45] Jun. 19, 1984

[54] DRAW-IRONED CAN FORMED OF SURFACE-TREATED STEEL PLATE AND PROCESS FOR PREPARATION THEREOF

[75] Inventors: Katsuhiro Imazu; Toshiaki Watanabe, both of Yokohama, Japan

[73] Assignee: Toyo Seikan Kaisha, Ltd., Tokyo, Japan

[21] Appl. No.: 315,951

[22] Filed: Oct. 28, 1981

[30] Foreign Application Priority Data

Nov. 1, 1980 [JP] Japan ..... 55-152980
Aug. 10, 1981 [JP] Japan ..... 56-124038

[51] Int. Cl.[3] ..... B65D 90/04

[52] U.S. Cl. ..... 220/456; 220/DIG. 22; 428/613; 428/646; 428/648; 428/681

[58] Field of Search ..... 428/613, 646, 648, 681, 428/682; 220/83, 456, DIG. 22

[56] References Cited

U.S. PATENT DOCUMENTS 2,327,127 8/1943 Rath ..... 428/649
2,500,915 3/1950 Tanner ..... 428/648
3,934,527 1/1976 Saunders ..... 220/456
3,978,803 9/1976 Asano et al. ..... 113/120 A
4,055,272 10/1977 Beese ..... 220/456
4,282,981 6/1981 Kitamura et al. ..... 220/75

OTHER PUBLICATIONS

Silman, H., et al.; *Protective and Decorative Coatings for Metals,* p. 556.

*Primary Examiner*—Michael L. Lewis
*Attorney, Agent, or Firm*—Sherman & Shalloway

[57] ABSTRACT

Disclosed is a draw-ironed can obtained by subjecting a surface-treated steel plate to draw-ironing, which consists of a relatively thick bottom portion and a relative thin barrel portion and has no seam in a joint portion between the barrel portion and bottom portion, wherein the barrel prtion has a surface layer containing tin in an amount of 0.01 to 1.70 g/m$^2$, the surface layer comprises (i) a tin-iron alloy layer or (ii) a combination of an iron surface and a tin-iron alloy layer at an exposed area ratio of 15 to 80%, and the surface layer of the bottom portion consists substantially of a tin-plated cover layer.

9 Claims, 4 Drawing Figures

DRAW-IRONED CAN FORMED OF SURFACE-TREATED STEEL PLATE AND PROCESS FOR PREPARATION THEREOF

BACKGROUND OF THE INVENTION

1. Field of the Invention

The present invention relates to a draw-ironed can composed of a surface-treated steel plate and a process for the preparation thereof. More particularly, the present invention relates to a draw-ironed can in which the amount plated of tin is much smaller than in draw-ironed cans composed of conventional tin-plated steel plates and the lacquer adhesion and corrosion resistance are highly improved, and a process for the preparation of such draw-ironed can.

2. Description of the Prior Art

A can body obtained by subjecting a metal blank to drawing between a punch and a die and then to ironing is advantageous in various points. For example, there is no seam in a barrel portion or in a joint portion connecting the barrel portion to a bottom portion, and the appearance is very good. Furthermore, double seaming of a bottom lid or formation of a seam need not be performed. Moreover, since the thickness of the barrel portion is reduced, the amount used of the metal blank can be reduced. Because of these advantages, these can bodies are widely used for canned drinks and foods.

Metal blanks for draw-ironed cans should possess a good formability. From the viewpoint of the formability, relatively expensive metal blanks such as aluminum plates and tin-plated steel plates (tinplates) are ordinarily used. Tin-plated steel plates involve a problem of exhaustion of tin resources, and the cost of tin is increasing year after year. Therefore, from the economical viewpoint, it is desired that the amount plated of tin should be reduced to a level as low as possible.

However, trials to reduce the amount plated of tin are limited from the viewpoints of the formability and corrosion resistance, because at the step of drawing and ironing a tin-plated steel plate, the tin layer acts as a solid lubricant and to a processed can body, the tin layer acts as a protecting cover layer. Therefore, tinplates #50 to #100 having a plated tin amount of 5.6 to 11.2 g/m$^2$ are now used as metal blanks to be draw-ironed.

SUMMARY OF THE INVENTION

We found that even when a tin-plated steel plate having a plated tin amount of 0.05 to 2.80 g/m$^2$, which is much smaller than the plated tin amount in tinplates customarily used as metal blanks to be draw-ironed is used, if a draw-ironed cup prepared through the ironing step is heated at a specific temperature, the tin-plated cover layer on the surface of the side wall of the cup is readily converted to a tin-iron alloy layer and if such tin-iron alloy layer is formed on the surface of the side wall, the lacquer adhesion and corrosion resistance of the can body are highly improved over those of the can body in which the tin-plated cover layer is left as it is. We have now completed the present invention based on this finding.

The present invention is characterized in that if the thickness of the plating layer of tin is extremely reduced, by a short time heating, such as 210° C.-30 seconds, which is industrially very advantageous, the tin-plated cover layer on the surface of the side wall of the can body can be converted to a tin-iron alloy layer.

Accordingly, the present invention is very advantageous from the industrial viewpoint.

It is a primary object of the present invention to provide a draw-ironed can in which the amount plated of tin is much smaller than the amount plated of tin in a conventional draw-ironed can formed of a tin-plated steel plate and the lacquer adhesion and corrosion resistance are highly improved, and a process for the preparation of such draw-ironed can.

Another object of the present invention is to provide a process for the preparation of draw-ironed cans, in which at the drawing and ironing step, a tin-plated cover layer sufficient to manifest a satisfactory action as a solid lubricant is maintained, and after completion of drawing and ironing, the tin-plated cover layer can be converted to a tin-iron alloy layer excellent in the lacquer adhesion and corrosion resistance.

In accordance with one aspect of the present invention, there is provided a draw-ironed can obtained by subjecting a surface-treated steel plate to draw-ironing, which consists of a relatively thick bottom portion and a relative thin barrel portion and has no seam in a joint portion between the barrel portion and bottom portion, wherein the barrel portion has a surface layer containing tin in an amount of 0.01 to 1.70 g/m$^2$, the surface layer comprises (i) a tin-iron alloy layer or (ii) a combination of an iron surface and a tin-iron alloy layer at an exposed area ratio of 15 to 80%, and the surface layer of the bottom portion consists substantially of a tin-plated cover layer.

In accordance with another aspect of the present invention, there is provided a process for the preparation of draw-ironed cans, which comprises subjecting a tin-plated steel plate to drawing between a punch and a die and to ironing, wherein a tin-plated steel plate having an amount plated of tin of 0.05 to 2.80 g/m$^2$ is used as the tin-plated steel plate, and a draw-ironed cup obtained through ironing is heated at a temperature higher than 150° C. to convert a tin-plated cover layer on the surface of the side wall of the cup to a tin-iron alloy layer.

Figure 1:
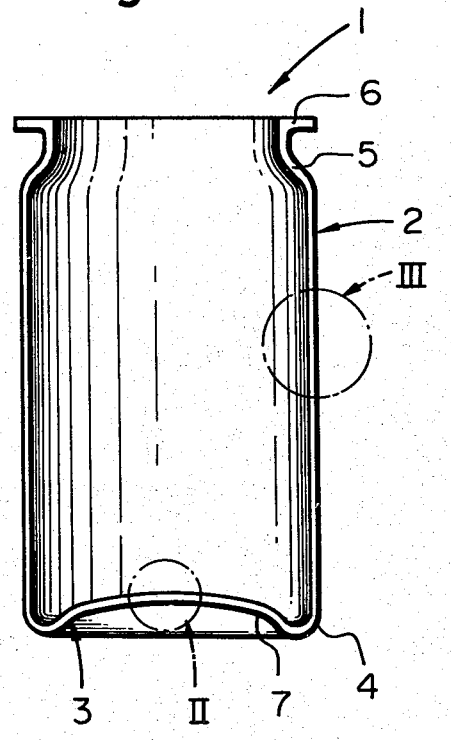
FIG. 1 is a diagram illustrating the entire structure of the draw-ironed can according to the present invention.

In the drawings, reference numerals 1, 2, 3, 4, 5, 6, 7, 8, 9, 10, 11, 12, 13 and 14 represent a can body, a barrel portion, a bottom portion, a joint between the barrel portion and bottom portion, a neck, a flange, a dome, a steel substrate, a cover layer, a tin-iron alloy layer, a steel substrate, a tin-iron alloy layer, a metallic tin layer and an exposed iron layer, respectively.

DETAILED DESCRIPTION OF THE PREFERRED EMBODIMENTS

The present invention will now be described in detail with reference to embodiments illustrated in the accompanying drawings.

Referring to FIG. 1 illustrating the entire structure of the draw-ironed can according to the present invention, this can 1 comprises a barrel portion generally indicated by reference numeral 2 and a bottom portion generally indicated by reference numeral 3. There is no substantial seam on the side face of the barrel portion 2 or in a joint portion 4 between the bottom portion 3 and the barrel portion 2. The barrel portion 2 is formed by subjecting a metal blank to drawing between a punch and a die and to ironing as described in detail hereinafter, and therefore, the thickness of the barrel portion 2 is smaller than that of the bottom portion 3.

If desired, a thick flange 6 is formed on the upper edge of the barrel portion 2 through a neck 5, so that double seaming is possible between the flange 6 and the peripheral edge of a can end member (not shown). A spherical smooth projection (dome) 7 is formed inwardly on the bottom portion 3 to prevent the bottom portion 3 from being bulged outwardly by the pressure of the packed content and to maintain a good sitting stability of the can.

The most important feature of the draw-ironed can of the present invention is that although the surface layer of the bottom portion 3 consists of a tin-plated cover layer, the barrel portion 2 has a surface layer containing tin in such a small amount as 0.01 to 1.70 g/m$^2$, especially 0.1 to 1.5 g/m$^2$, and this surface layer comprises (i) a tin-iron alloy layer or (ii) a combination of an iron surface and a tin-iron alloy layer at an exposed area ratio of 15 to 80%, especially 25 to 60%.

As pointed out hereinbefore, a conventional tin-plated steel plate for draw-ironing has a relatively large amount plated of tin. According to the present invention, although the total amount of tin present on the surface of a draw-ironed can is much smaller than in a conventional draw-ironed can, the formability is not degraded at all and conversion to a tin-iron alloy is easily accomplished, and the lacquer adhesion and corrosion resistance of the can body can be prominently improved.

In the present invention, whether the surface layer of the barrel portion consists essentially of (i) a tin-iron alloy layer or (ii) a combination of an iron surface and a tin-iron alloy layer depends on whether the metal blank used is (i) a bright (reflow) plate obtained by fusing tin on an electrically tin-plated steel plate or (ii) a tin-plated steel plate as-prepared by electric plating, that is, a mat (noreflow) plate. Namely, in case of the mat plate (noreflow plate), iron is readily exposed to the surface. In the latter embodiment of the present invention, tin is present in the above-mentioned amount in the form of a tin-iron alloy layer. However, microscopically, the tin-free iron surface is exposed.

In the field of canned foods and drinks, various surface-treated steel plates are used in order to prevent dissolution of iron into contents, and it has been considered that even exposure of a microscopic iron surface is not preferred. In contrast, according to the present invention, by exposing an iron surface at a specific area ratio on the surface of the barrel portion of a can body formed by drawing and ironing of a tin-plated steel plate, the lacquer adhesion can be improved. This fact will be apparent from the relation between the iron-exposed surface area ratio and the peel strength, which is illustrated in Examples given hereinafter.

As pointed out hereinbefore, in a conventional tin-plated steel plate for draw-ironing, the amount plated of tin is relatively large. According to the present invention, although the total amount of tin present on the surface of the draw-ironed can is much smaller than in the conventional draw-ironed can, the intended draw-ironed can body can easily be obtained without degradation of the formability, and furthermore, the lacquer adhesion and corrosion resistance of the can body can be prominently improved.

Figure 2:
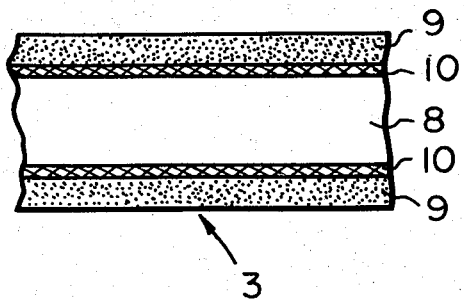
FIG. 2 is an enlarged view showing the section of the bottom portion II of the draw-ironed can shown in FIG. 1.

Referring to FIG. 2 which is an enlarged view showing the section of the bottom portion 3, the bottom wall 3 comprises a steel substrate 8, a tin-plated cover layer 9 and a tin-iron alloy layer 10 which is formed between the substrate 8 and the tin-plated cover layer 9 in some cases. Since this bottom portion 3 is not subjected to drawing and ironing, the amount plated of tin is the same as in the blank, that is, 0.05 to 2.80 g/m$^2$.

Figure 3:
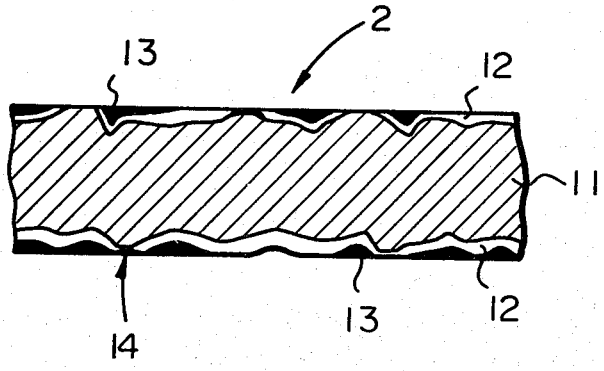
FIG. 3 is an enlarged view showing an example of the surface structure of the barrel portion III of the draw-ironed can shown in FIG. 1.

Referring to FIG. 3 which is an enlarged view showing the section of the side wall of the barrel portion 2, this side wall 2 comprises a steel substrate 11 and a tin-iron alloy layer 12 formed on the steel substrate 11. There may be locally present a metallic tin layer 13 and an exposed iron surface 14 on the tin-iron alloy layer 12.

Figure 4:
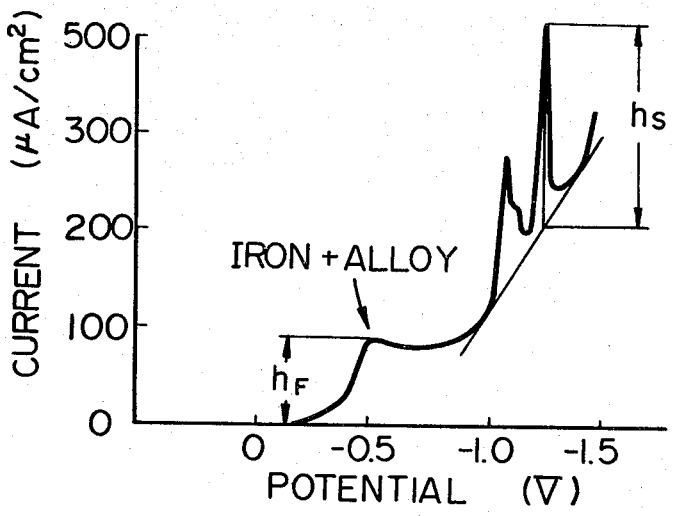
FIG. 4 is a polarization curve showing the relation between the polarization in the surface of the barrel portion and the quantity of the reduction current.

The exposed ratio of the iron surface and/or the tin-iron alloy layer on the side wall 2 of the barrel portion, referred to in the instant specification and appended claims, means the value obtained according to the following method. A potentiostat (constant voltage electrolysis apparatus) is used, and a saturated calomel electrode is used as the reference electrode and platinum is used as the counter electrode. The surface of the barrel portion having a certain area exposed, to be measured, is dipped in a 0.05 N aqueous solution of anhydrous sodium carbonate having the pH value adjusted to 9.5 by sodium hydrogen-carbonate, and polarization is first effected from −200 mV to −1450 mV and then from −1450 mV to +550 mV. Finally, polarization is effected from +550 mV to −1300 mV while determining a polarization curve. In each case, polarization is continuously performed at a constant speed of 1000 mV/min. The obtained polarization curve is shown in FIG. 4. An operation of removing dirt, oxide film and surface treatment film from the surface of the sample to be measured may be performed prior to the measurement according to need. One peak is observed in the region of from −450 mV to −800 mV in the so obtained polarization curve, and this corresponds to the sum of the iron surface and tin-iron alloy layer. Furthermore, three peaks at most are observed in the region of from −1000 mV to −1250 mV in the polarization curve. The first occurring peak is attributed to tin, the next peak is attributed to iron and the third peak is attributed to the tin-iron alloy. These peaks can be discriminated from polarization curves of pure substances and mixtures thereof obtained according to the above-mentioned method.

The exposed surface area SA of the tin-iron alloy layer is defined by the following formula:

$$SA(\%)=0.21\times hs$$

wherein hs stands for the peak height ($\mu$A/cm$^2$) of the tin-iron alloy layer of the sample appearing at about −1150 mV as shown in FIG. 4.

The peak of iron appearing at −1000 to −1250 mV is not quantitatively precise. Accordingly, the exposed surface area ratio SB of the iron surface is defined by the following formula:

$$SB(\%)=0.52(hf-0.14hs)$$

wherein hs is as defined above and hf represents the height ($\mu A/cm^2$) of the peak appearing at −450 to −800 mV.

In the present invention, it is important that the area ratio of the iron exposed surface should be 15 to 80%, especially 25 to 60%. If this area ratio is lower than 15%, no substantial improvement of the lacquer adhesion can be expected, and if the area ratio is higher than 80%, the formability is degraded and prevention of rusting becomes incomplete.

As is readily be understood if FIG. 2 is compared with FIG. 3, the thickness of the barrel portion 2 is smaller than the thickness of the bottom portion 3, because the barrel portion 2 has been subjected to drawing and ironing. Therefore, the plated tin layer left on the surface of the barrel portion after drawing and ironing should naturally have a thickness smaller than that of the plated tin layer on the surface of the bottom portion. According to the present invention, if has been found that if this thin plated tin layer is heated and converted to a tin-iron alloy layer 12, the lacquer adhesion and corrosion resistance are highly improved over those attained when the thin plated tin layer is left as it is. The tin-iron alloy layer is formed by thermal diffusion of metallic tin as the plating layer and iron as the substrate. In the present invention, the degree of this thermal diffusion is controlled so that the iron exposed surface area mentioned hereinbefore is at least 15%, especially at least 25%.

This tin-iron alloy layer 12 is hardly soluble in a carbonated drink such as cola. The potential of the tin-iron alloy layer 12 is higher than that of iron as the substrate metal, but the potential difference between the tin-iron alloy and iron is small and the degree of corrosion of iron as the substrate metal is very low and only facial corrosion takes place. In case of juices, this tin-iron alloy layer protects iron as the substrate metal.

The thickness of the tin-iron alloy layer on the side wall of the barrel portion in which the amount plated of tin is very small, and therefore, the formability is very good and the lacquer adhesion is excellent. Accordingly, the coating is not cracked at all at the processing step.

As the tin-iron alloy layer 12 is formed on the side wall of the barrel portion 2, a tin-iron alloy layer 10 is also formed on the bottom portion 3. Since the thickness of the plated tin layer of the bottom portion 3 is larger than that of the plated tin layer in the barrel portion, this tin-iron alloy layer 10 seldom reaches the surface and the tin-plated cover layer 9 is readily left on the surface.

In the draw-ironed can of the present invention, it is preferred that the ironing ratio RD defined by the following formula:

$$\frac{D-d}{D} \times 100 = RD$$

wherein D stands for the thickness of the bottom portion and d stands for the thickness of the barrel portion 2, be 40 to 80%, especially 50 to 70%, and that D be in the range of from 0.27 to 0.50 mm and d be in the range of from 0.080 to 0.220 mm.

It is ordinarily preferred that the average thickness of the tin-iron alloy layer 12 be 0.005 to 0.2 micron and the tin/iron atomic ratio in the tin-iron alloy layer 12 be in the range of from 2/1 to 1/3.

The draw-ironed can of the present invention can be formed by subjecting a tin-plated steel plate having an amount plated of tin of 0.05 to 2.80 $g/m^2$ (in the instant specification, by the amount plated of tin is meant an amount of tin plated on one surface), especially a tin-plated steel plate in which the amount of tin plated on the surface which will be the outer surface of the resulting draw-ironed can is 1.00 to 2.80 $g/m^2$ and the amount of tin plated on the surface which will be the inner surface of the resulting draw-ironed can is 0.05 to 2.80 $g/m^2$, to drawing between a punch and a die and ironing according to known procedures, and heating the resulting draw-ironed cup at a temperature higher than 150° C. to convert the tin-plated cover layer to a tin-iron alloy layer.

As the tin-plated steel plate, there can be used a tin-plated steel plate obtained by plating tin in the above-mentioned amount on a low-carbon rolled steel plate. Either an as-plated mat plate (noreflow plate) or a bright plate (reflow plate) formed by performing the fusion treatment after plating can be used in the present invention. From the viewpoint of the draw-ironing formability, the former mat plate is advantageous. However, from the viewpoint of conversion to the tin-iron alloy, the latter bright plate is advantageous.

In the case where the amount plated of tin is smaller than 0.05 $g/m^2$ in the starting tin-plated steel plate, the draw-ironing formability is drastically reduced, and if the amount plated of tin is larger than 2.80 $g/m^2$, a large quantity of heat is necessary for advancing alloying to the surface, and the object of the present invention, that is, reduction of the amount used of expensive tin, is not attained.

For the draw-ironing processing, the known combination of a punch and a die may be used, and the draw-ironing processing can be accomplished very easily according to customary procedures while supplying a lubricant between the blank and die if necessary. It is preferred that at the ironing step, the ironing ratio be maintained within the above-mentioned range.

The draw-ironed cup formed by the draw-ironing processing is heated at a temperature higher than 150° C. to convert the tin-plated cover layer on the surface of the side wall of the barrel portion to a tin-iron alloy layer. Formation of the alloy layer by diffusion of metallic tin and iron vigorously occurs at a temperature higher than the melting temperature of tin (232° C.), but even when the temperature is lower than this melting temperature, if only the temperature is higher than 150° C., formation of the alloy layer is advanced as in case of full forge welding. The heating condition necessary for providing the tin-iron alloy layer exposed area ratio of at least 15% on the side wall of the barrel portion varies depending on the amount of plated tin left on the side wall of the barrel portion, and the smaller is the amount of tin left on the side wall of the barrel portion, the smaller is the thermal energy necessary for providing the above exposed area ratio. In case of a can body formed from the above-mentioned tin-plated steel plate #50 to #100 now practically used in the art, since the amount of plated tin left on the side wall of the barrel portion is very large, a very large quantity of thermal energy is necessary for providing a tin-iron alloy layer exposed area ratio of at least 15%, and therefore, use of such tin-plated steel plate is not preferred from the practical viewpoint.

In contrast, in the case where the amount of tin left on the side wall of the barrel portion is within the range specified in the present invention, a tin-iron alloy layer exposed area ratio of at least 15% can be attained very easily if appropriate heating conditions are selected from heating temperatures of 150° to 300° C. and heating times of 15 seconds to 10 minutes. Accordingly, the practical value of the present invention is very high.

Ordinarily, the tin-iron alloy layer exposed area ratio can be increased to at least 15% by carrying out the heat treatment only once. However, if desired, the multi-staged heat treatment may be adopted.

In the present invention, instead of the above-mentioned method in which the heat treatment is carried out independently from the draw-ironing processing, there may be adopted a method in which a heat treatment conducted for the production of a draw-ironed can is utilized for formation of the tin-iron alloy layer. For example, if the heat treatment for drying after degreasing and pickling or the heat treatment for baking a lacquer or ink is modified so that the above conditions are satisfied, the intended tin-iron alloy layer can be formed by such heat treatment.

In the present invention, when a mat plate (noreflow plate) having an average surface roughness (Ra) of 0.2 to 4 microns, especially 0.5 to 2 microns, is used as the metal blank, it is important that the above heat treatment should be carried out so that the iron surface is not excessively oxidized. In this case, the heat treatment is carried out at a temperature in the range of from 150° C. to the melting temperature (232° C.) of tin for 15 seconds to 10 minutes. In some cases, in order to prevent excessive oxidation or rusting of the iron surface or pitting of the iron surface by the packed content, it is preferred that the iron surface-exposed portion be rendered passive by a customary surface treatment such as a phosphoric acid salt treatment, a phosphoric acid-chromic acid treatment or a chromic acid treatment.

Since the lacquer adhesion of the draw-ironed can of the present invention is especially excellent, even if the can is subjected to beading of the barrel portion or to multi-staged necking, formation of cracks or pinholes is prevented, and the lacquer layer adheres closely to the metal substrate and there can be obtained a covered can excellent in the corrosion resistance, in which the degree of exposure of the metal is controlled to such a low level that the packed content is not substantially influenced. This is another prominent advantage attained by the present invention.

The present invention will now be described in detail with reference to the following Examples that by no means limit the scope of the invention.

EXAMPLE 1

A bright tin-plated steel plate having a thickness of 0.32 mm, a hardness of T-2, a surface roughness Ra of 1 μm and an amount plated of tin of 1.68 g/m$^2$ (on both the inner and outer surfaces) was cut into discs having a diameter of about 130 mm, and the discs were processed between a drawing punch and a drawing die according to customary procedures to form cups having an inner diameter of about 53 mm.

Then, the cups were ironed between an ironing punch and an ironing die to obtain can bodies having the following dimensions and physical properties.

Thickness (D) of bottom portion: 0.32 mm
Thickness (d) of barrel portion: 0.10 mm
Ironing ratio (RD): 68.7%
Inner diameter of can body: 53 mm
Height of can body: 135 mm
Volume of can body: 300 ml
Tin-iron alloy layer exposed area ratio: 2 to 5%

Both the inner and outer surfaces of the can body were degreased and pickled, and a 2.5% aqueous solution of sodium phosphate was sprayed on both the inner and outer surfaces of the can body at 80° C. for 20 seconds to form a surface treatment film. Then, an epoxy-urea type lacquer was then coated.

The coated can body was heat-treated at 210° C. for 3 minutes to form an alloy layer. The tin-iron alloy layer exposed area ratio was about 30%. The T-peel strength indicating the lacquer adhesion was 1.5 to 2.0 Kg/cm. Then, a carbonated drink (cola) was packed in a can body and a lid was double-seamed to the can body, and the resulting canned carbonated drink was subjected to a store test at 50° C.

After 1 week's or 6 months' storage, the can was opened, and the inner surface was examined and the state thereof was evaluated.

In case of the can bodies according to the present invention, pitting was not observed in the can bodies after 1 week's storage or after 6 months' storage, and defects such as peeling of the lacquer coating were not observed.

Adhesion of outer surface lacquers was examined in the following manner.

A white coat lacquer and a finishing varnish were applied to the outer surface of the above-mentioned can body according to the present invention and a carbonated drink containing a fruit juice at a low concentration was packed. When the packed can was heated and sterilized by a can warmer or pasteurizer, it was found that peeling of the white coat layer or finishing varnish layer was not caused by such heat treatment and none of other defects were brought about.

In order to demonstrate the excellent effects of the present invention, comparative can bodies were prepared in the same manner as described above except that changes described below were made, and the resulting comparative can bodies were tested.

(1) Comparative Can Body A

This can body was prepared in the same manner as described above except that the amount plated of tin was changed to 11.2 g/m$^2$.

(2) Comparative Can Body B

This can body was prepared in the same manner as described above except that the amount plated of tin was changed to 5.6 g/m$^2$.

These comparative can bodies were compared with the above-mentioned can body of Example 1 with respect to the tin-iron alloy layer exposed area ratio and the coating adhesion strength (T-peel strength) on the inner surface side of the barrel portion to obtain results shown in Table 1.

TABLE 1

| Can Body | Exposed Area Ratio (%) | Coating Adhesion Strength (T-peel strength, Kg/cm) |
|---|---|---|
| Example 1 | 40 | 1.5–2.0 |
| Comparison A | 5–10 | 0.4–0.8 |
| Comparison B | 10–14 | 0.6–0.9 |

From the results shown in Table 1, it will readily be understood that the coating adhesion strength is influenced by the tin-iron alloy layer exposed area ratio and if the tin-iron alloy layer exposed area ratio is adjusted within the range specified in the present invention, a can excellent in the lacquer adhesion strength can be obtained.

EXAMPLE 2

The same metal blank as used in Example 1 was treated so that the amount plated of tin was 1.70 g/m$^2$ on the outer surface and 0.56 g/m$^2$ on the inner surface, and a draw-ironed cup was prepared from this blank in the same manner as described in Example 1 and a can body was prepared from this cup in the same manner as described in Example 1. When the coating adhesion strength was measured, it was found that the T-peel strength was 1.3 Kg/cm. The tin-iron alloy exposed area ratio was 70% on the outer surface and 80% on the inner surface.

EXAMPLE 3

The resistance to packed contents was examined. The can bodies of Example 1 and comparisons A and B were pickled and a 2.5% aqueous solution of sodium phosphate having a pH value of 4.5 was sprayed on the inner and outer surfaces of the can bodies to form surface treatment films and render the iron surfaces passive. Then, the heat treatment was carried out at 225° C. for about 90 seconds to form an alloy layer. Then, an epoxy-urea lacquer was coated on the can bodies.

A carbonated drink of the cola or citric acid type was packed in the can bodies and lids were double-seamed thereto. After the packed cans were stored at 50° C. for 6 months, the cans were opened, and the amount of iron dissolved out into the content was measured and the state of pitting was examined. The obtained results are shown in Table 2.

TABLE 2

| | Amount of Dissolved Iron (ppm) | | Number of Cans Where Pitting Was Observed (among 900 cans tested) | |
|---|---|---|---|---|
| Can Body | cola type | citric acid type | cola type | citric acid type |
| Example 1 | 0.2 | <0.1 | 0 | 0 |
| Comparison A | 0.3 | <0.1 | 0 | 0 |
| Comparison B | 0.5 | 0.2 | 5 | 3 |

In the cola-packed cans, corrosion took place in the double-seamed portion of the necked portion close to the double-seamed portion, and pitting was caused in the necked portion close to the double-seamed portion.

From the results shown in Table 2, it will readily be understood that the can body according to the present invention is excellent in the resistance to packed contents and is very valuable as a can for carbonated drinks.

EXAMPLE 4

A mat tin-plated steel plate having a thickness of 0.32 mm, a hardness of T-2½, a surface roughness Ra of 1 μm and an amount plated of tin of 1.7 g/m$^2$ (on both the inner and outer surfaces) was cut in discs having a diameter of about 145 mm, and the discs were processed between a drawing punch and a drawing die according to customary procedures to form cups having an inner diameter of about 72 mm.

Then, the cups were ironed between an ironing punch and an ironing die to obtain can bodies having the following dimensions and physical properties.

Thickness (D) of bottom portion: 0.32 mm
Thickness (d) of barrel portion: 0.09 mm
Ironing ratio: 72%
Inner diameter of barrel portion: 65.4 mm
Inner diameter of necked portion: 61.0 mm
Height of barrel portion: 122 mm
Iron exposed area ratio: 35%

The can body was degreased and pickled on both the inner and outer surfaces and was then heated at 225° C. for 90 seconds in an inert atmosphere, and an epoxy-urea lacquer was coated on the heat-treated can body. The coating adhesion strength was 0.3 to 0.5 Kg/5 mm as the 180° peel strength.

After the necking processing, a carbonated drink (cola) was packed in the can body and a lid was double-seamed thereto. The packed can was stored at 50° C. After 1 month's or 6 months' storing, the can was opened and the inner surface was examined. In case of the can body of the present invention, pitting on the can body was not observed after 1 month's storing or after 6 months' storing. Moreover, peeling of the coating was not observed.

In order to evaluate the adhesion of outer surface lacquers, the following experiment was carried out. A white coat lacquer and a finish varnish were applied to the outer surface of the can body and a carbonated drink containing a fruit juice at a low concentration was packed in the can body and a lid was double-seamed thereto. The packed can was heated and sterilized in a can warmer or pasteurizer. Even if the can body of the present invention was subjected to such heat treatment, peeling of the white coat layer or the finishing varnish layer was not caused at all, and the content-preserving property was very good.

EXAMPLE 5

A draw-ironed cup was prepared in the same manner as described in Example 4 by using a tin-plated steel plate having a surface roughness Ra of 2 μm, in which the amount plated of tin was 1.70 g/m$^2$ on the outer surface and 0.5 g/m$^2$ on the inner surface, and a can body was prepared from this cup in the same manner as described in Example 4. The coating adhesion strength on the inner surface was higher than 1.0 Kg/5 mm.

When an epoxy-phenolic lacquer was coated on the can body, it was found that the coating adhesion strength was at least 3.5 Kg/5 mm on the inner surface and at least 1.5 Kg/5 mm on the outer surface.

The iron exposed area ratio was 35% on the outer surface and 60% on the inner surface.

EXAMPLE 6

The resistance to packed contents was examined. A 2.5% aqueous solution of sodium phosphate having a pH value of 4.5 was sprayed at 80° C. for 20 seconds on the inner and outer surfaces of the can body obtained in Example 4 to form a surface treatment film and render the iron surface passive. Then, an epoxy-urea lacquer was coated.

A carbonated drink of the cola or citric acid type was packed as the content in the so treated can body and a lid was double-seamed thereto. The packed can was stored in a tank maintained at 50° C. for 6 months. The can was opened, and the amount of iron dissolved out in the content was measured and the state of pitting was observed. Ptting was not observed in any of 900 cans tested, and the amount of dissolved iron was 0.2 ppm in case of the cola and lower than 0.1 ppm in case of the citric acid type drink.

EXAMPLE 7

A bright tin-plated steel plate having a thickness of 0.32 mm, a hardness of T-2½, a surface roughness Ra of 0.5 μm and an amount plated of tin of 2.2 g/m² (on both the inner and outer surfaces) was drawn, ironed and coated in the same manner as described in Example 4. The iron exposed area ratio was 30%. The coating adhesion strength was 0.4 Kg/5 mm as the 180° peel strength.

EXAMPLE 8

The epoxy-phenolic lacquer-coated can body obtained in Example 5 was subjected to three-staged necking processing so that the diameter after necking was 57 mm. A carbonated drink of the cola type was packed in the can body and a lid was double-seamed thereto, and the packed can was stored at 50° C. for 6 months. The can was opened and the state of the inner surface was examined. Occurrence of pitting was not observed, and the amount of iron dissolved out into the content was 0.4 ppm. Peeling or rising of the inner face coating was not observed at all.

EXAMPLE 9

The epoxy-phenolic lacquer-coated can body obtained in Example 5 was beaded and necked so that the diameter after the necking processing was 61 mm. The can was filled with 50% orange juice, nitrogen was introduced into the head space and a lid was double-seamed to the can body. The packed can was stored at 37° C. for 6 months. The can was opened and the state of the inner face coating was examined. Rising or peeling of the inner face coating was not observed. The amount of iron dissolved in the content was 1 ppm and the amount of tin dissolved in the content was lower than 0.1 ppm.

What we claim is:

1. A draw-ironed can obtained by subjecting a surface-treated steel plate to draw-ironing, which consists of a relatively thick bottom portion and a relatively thin barrel portion and has no seam in a joint portion between the barrel portion and bottom portion, wherein said surface-treated steel plate is a bright plate obtained by fusing tin on an electrically tin-plated steel plate, the barrel portion has a surface layer containing tin in an amount of 0.01 to 1.70 g/m², the surface layer comprises a tin-iron alloy layer having an exposed area ratio (SA) of from 25% to 80%, and the surface layer of the bottom portion consists substantially of a tin-plate cover layer in an amount of tin of 0.05 to 2.80 g/m², and said exposed area ratio (SA) is defined by the following formula:

$$SA(\%)=0.21\times hs$$

wherein hs stands for the peak height (μA/cm²) of the tin-iron alloy layer of the sample appearing at about −1150 mV in a polarization curve obtained by dipping the sample in a 0.05 N aqueous solution of anhydrous sodium carbonate having the pH value adjusted to 9.5 by sodium hydrogen-carbonate, and effecting polarization first from −200 mV to −1450 mV, then from −1450 mV to +550 mV and finally, from +550 mV to −1300 mV.

2. A draw-ironed can as set forth in claim 1, wherein the exposed area ratio of the surface layer is 25 to 60%.

3. A draw-ironed can as set forth in claim 1, which has been subjected to a phosphoric acid salt treatment, a phosphoric acid-chromic acid treatment or chromic acid treatmemt.

4. A draw-ironed can obtained by subjecting a surface-treated steel plate to draw-ironing, which consists of a relatively thick bottom portion and a relatively thin barrel portion and has no seam in a joint portion between the barrel portion and bottom portion, wherein the surface-treated steel plate is a mat tin-coated steel plate as-prepared by electric plating, the barrel portion has a surface layer containing tin in an amount of 0.01 to 1.70 g/m², the surface layer comprises a combination of an iron surface and a tin-iron alloy layer at an iron exposed area ratio (SB) of 15 to 80%, the surface layer of the bottom portion consists substantially of a tin-plated cover layer in an amount of tin of 0.05 to 2.80 g/m², and said iron exposed area ratio (SB) is defined by the following formula:

$$SB(\%)=0.52(hf-0.14hs)$$

wherein hs and hf represent the height (μA/cm²) of the peak appearing at about −1150 mV and the height (μA/cm²) of the peak appearing at −450 to −800 mV, respectively, in a polarization curve obtained by dipping the sample in a 0.05 N aqueous solution of anhydrous sodium carbonate having the pH value adjusted to 9.5 by sodium hydrogen-carbonate, and effecting polarization first from −200 mV to −1450 mV, then from −1450 mV to +550 mV and finally, from +550 mV to −1300 mV.

5. A draw-ironed can as set forth in claim 4, which has been subjected to a phosphoric acid salt treatment, a phosphoric acid-chromic acid treatment or chormic acid treatment.

6. A draw-ironed can as set forth in claim 4 wherein the barrel portion has a surface layer containing tin in an amount of 0.1 to 1.5 g/m².

7. A draw-ironed can as set forth in claim 1 wherein the barrel portion has a surface layer containing tin in an amount of 0.1 to 1.5 g/m².

8. A draw-ironed can as set forth in claim 1 wherein the tin-iron alloy layer has an average thickness of from 0.005 to 0.2 micron and a tin-iron atomic ratio in the range of from 2/1 to 1/3.

9. A draw-ironed can as set forth in claim 4 wherein the tin-iron alloy layer has an average thickness of from 0.005 to 0.2 micron and a tin-iron atomic ratio in the range of from 2/1 to 1.3.

* * * * *